US005243063A

United States Patent [19]

Devicaris et al.

[11] Patent Number: 5,243,063

[45] Date of Patent: Sep. 7, 1993

[54] METHOD FOR INHIBITING FOULANT FORMATION IN A NON-AQUEOUS PROCESS STREAM

[75] Inventors: Guy A. Devicaris, Quakertown, Pa.; Kaj D. Rondum, Budd Lake; Dwight E. Emerich, Lincoln Park, both of N.J.

[73] Assignee: Ashchem I.P., Inc., Dublin, Ohio

[21] Appl. No.: 791,077

[22] Filed: Nov. 12, 1991

[51] Int. Cl.[5] ..... C07C 255/07

[52] U.S. Cl. ..... 558/304

[58] Field of Search ..... 558/304

[56] References Cited

U.S. PATENT DOCUMENTS

| | | | |
|---|---|---|---|
| 2,446,969 | 8/1948 | Welch et al. | 260/666.5 |
| 2,483,778 | 10/1949 | Morrell et al. | 260/666.5 |
| 2,947,795 | 8/1960 | Keown | 260/678 |
| 3,148,225 | 9/1964 | Albert | 260/669 |
| 4,237,326 | 12/1980 | Fuga et al. | 585/4 |
| 4,487,745 | 12/1984 | Weiss et al. | 422/16 |
| 4,927,519 | 5/1990 | Forester | 208/48 AA |

*Primary Examiner*—Mary C. Lee
*Assistant Examiner*—Joseph K. McKane
*Attorney, Agent, or Firm*—Wood, Herron & Evans

[57] ABSTRACT

A method for inhibiting fouling in an organic process stream which is substantially non-aqueous by the addition of certain oxime compounds.

5 Claims, No Drawings

METHOD FOR INHIBITING FOULANT FORMATION IN A NON-AQUEOUS PROCESS STREAM

FIELD OF THE INVENTION

The invention relates to a method for inhibiting formation of foulants in a substantially non-aqueous organic process stream by the addition of one or more of certain oxime compounds.

BACKGROUND OF THE INVENTION

In a wide variety of applications wherein organic compounds are used or processed, one must be concerned about the occurrence of fouling in the processing equipment. Fouling in an organic stream or system occurs as a result of polymerization or other reaction of at least a portion of the organic components in the stream or system to form a higher molecular weight product having reduced solubility in the organic components. The reduced solubility causes the higher molecular weight product, i.e., the foulant, to separate from the organic components and clog or obstruct transfer lines, settle out from the components, and otherwise coat the surfaces of the processing equipment. The formation of undesirable foulants occurs in process streams having only organic as well as both organic and aqueous phases. The aqueous phase may be merely water entrained in the organic stream during processing, but also includes the water added to quench or cool a reaction or to remove certain water soluble components from the organic stream by a process step, such as steam stripping. Where water is present in the organic stream, the presence of water-soluble dissolved materials which may catalyze or enhance polymerization or other reaction must be considered.

Reaction occurs because the organic compounds are subjected to conditions sufficient to cause modification of the chemical structure of one or more of the organic components of the stream or system. Conditions which affect reactivity include temperature, pressure, pH and presence of trace metals and other contaminants. For example, it is known that in the process of thermally cracking a feedstock blend of naphtha and gas oil to produce short chain thermal cracking products such as ethylene, propylene, ethane, treated pyrolysis gasoline and various mixed hydrocarbon streams, the existing processing temperatures, pressures and presence of trace contaminants cause further reaction of one or more of the thermal cracking products to create oligomers, polymers and oxidized products which are capable of fouling the processing equipment.

The secondary reaction products formed in process streams such as that described above are undesirable for several reasons. First, if the secondary reaction product is soluble in the thermal cracking product stream, it exists as an impurity which must be removed by distillation, solvent extraction, or other separation technique. If alternatively the secondary reaction product is insoluble in the process stream, it tends to settle out of the stream and accumulate in the low-lying portions of the process stream transport system. The insoluble secondary reaction product may also plate out from the stream and coat all exposed walls of the process stream transport system, including piping, pumps, heat exchanger cores, storage tanks, and the like. In either case, the secondary reaction products eventually form substantial deposits within the process stream transport system.

These deposits can cause damage to the transport system by building up significant over-pressures within the system, and by limiting the through-put of desirable product. Ultimately, these deposits must be removed, typically by shutting down the entire system and physically removing the deposits. This results in substantial cost, both in lost operating time and in maintenance.

The chemical reactions occurring in organic streams which produce foulants are varied and complex. The most prevalent cause of fouling in an organic stream results from polymerization of one or more organic components of the organic stream. Typically the undesirable foulant polymers are formed by reactions of unsaturated hydrocarbons. Formation of undesirable foulants can be enhanced by the presence of trace organic materials containing hetero atoms such as nitrogen, oxygen, and sulfur.

Polymers are formed in organic streams by free radical chain reactions, which consist of an initiation phase followed by a propagation phase. A free radical is formed from a molecule by the removal of a single electron, the free radical thus having a single odd electron remaining which is available for further reaction. This free radical then reacts with other molecules or free radicals in the organic stream to either propagate the chain or to terminate the chain. The presence of oxygen in the organic stream can itself accelerate the polymerization process by facilitating formation of free radicals. Also, trace amounts of metal impurity carried along from earlier catalytic processes or from the walls of the metal piping itself can act as generators of free radicals. A more detailed explanation of the various reactions involved in the formation of foulants is found in U.S. Pat. No. 4,927,519, issued May 22, 1990, which is incorporated herein by reference.

It is desirable, and highly recommended, to minimize the presence of those materials which cause or enhance formation of foulants, such as oxygen, metals, free radicals and the like. Additional mechanical purification of the organic stream, such as by filtration or centrifugation, aids in reducing the presence of trace metal particles and other insoluble contaminants. Where possible, vacuum and heat are known to be applied to such streams to deaerate or deoxygenate the process stream containing organic materials both with and without water. However, these mechanical treatment methods still leave low levels of contaminants in the stream which subsequently react.

It is known to employ chemical treatments to control fouling deposit formation. U.S. Pat. No. 4,927,519 discloses an antifoulant composition added directly to a hydrocarbonaceous stream comprising a basic antifouling compound wherein one component is selected from the group consisting of alkyl phosphonate phenate sulfide, alkaline earth alkyl phosphonate phenate sulfide, and amine neutralized alkyl phosphonate phenate sulfide, and mixtures thereof, combined with at least one additional compound which is an effective antioxidant, a corrosion-inhibiting compound, or a metal deactivator. U.S. Pat. No. 3,148,225 discloses the use of certain lower alkyl N, N-dialkylhydroxylamines to inhibit popcorn polymer formation during the preparation of synthetic rubber from styrene and butadiene. Notwithstanding the above materials for use in limiting formation of foulants as well as additional known additives having anti-foulant properties, there remains a continued need for alternate and improved methods for inhibiting foulant formation.

SUMMARY OF THE INVENTION

It has been found that the fouling tendencies of organic compounds in a substantially non-aqueous process stream are inhibited by adding an effective amount of one or more oxime compounds. Specifically, it has been found that one or more materials derived from the oxime are active agents in inhibiting fouling of the organic compounds.

As discussed in co-pending patent application Ser. No. 652,943, assigned to the assignee of the present invention, it was believed that the active agent deriving from the oxime compound required the presence of water before it could be formed. It has been subsequently determined that the active agent does not require the presence of water for its formation. However, elevated temperatures are necessary to form the active agent. It is believed that the agent or agents formed by treating the particular oxime compound scavenges free radicals in the non-aqueous process stream containing those organic materials which are capable of further polymerizing or otherwise reacting.

In addition to effectively inhibiting the polymerization or other free radical-based reaction of one or more components of the organic material stream, the anti-foulants used in carrying out the method of this invention have the further advantage of aiding in metal coordination by reducing metallic ions to a lower, more soluble oxidation state. In this state, the metal ions are more easily sequestered or chelated by a separate additive to form a heat stable complex which renders the metal ions unavailable as a catalyst.

DETAILED DESCRIPTION OF THE INVENTION

The invention in its broader aspects relates to a method for inhibiting fouling caused by the reaction of organic compounds in a process stream which is substantially free of water, comprising adding to the process stream an effective amount of an oxime compound, the oxime compound heated to at least about 100° C. and having the formula

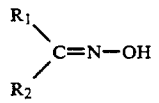

in which $R_1$ and $R_2$ are the same or different and are selected from hydrogen, lower alkyl groups of 1-8 carbon atoms and aryl groups.

As demonstrated below, the oxime compound itself does not perform the desired antifouling function of this invention. Rather, one or more components formed from the oxime has been found to function to scavenge free radicals and inhibit the polymerization or other reaction of the organic material in contact with the effective component formed from the oxime.

The composition of fast scavenger is not known. It is a relatively unstable species, derived from an oxime, and decomposes under the action of heat, requiring replenishment by breakdown of additional oxime. It is theorized that the fast scavenger component is a free radical thermolysis decomposition product of the oxime. In general, the rate of generation of fast scavenger from oxime will exceed the destruction of fast scavenger by heat. Therefore, a significant and useful concentration of fast scavenger can be maintained.

The amount of fast scavenger needed to prevent fouling of the organic material varies with the type of organic material and the process and conditions to which the organic material is being subjected. Thus, a relatively stable blend of organic compounds, such as saturated hydrocarbons, being processed under mild temperatures in the absence of oxygen and metal contaminants would not be likely to form appreciable amounts of free radicals which would lead to polymerization. In this instance, very little fast scavenger would be required to scavenge the free radicals formed. Where the organic material has one or more components which are more easily polymerized, especially under conditions of high temperature, pressure and in the presence of oxygen or trace amounts of metal, the need for scavenging of free radicals is substantially increased. In these instances, higher levels of fast scavenger may be required.

The amount of fast scavenger required can be readily determined by someone skilled in the art, though the determination is primarily qualitative. One measure of the presence of foulants is the viscosity of the process stream. Thus, one method of determining the amount of fast scavenger needed is to increase the concentration level until a minimum viscosity is obtained. Overdosing of the oxime in the process stream is not recommended, as this can form undesirably high levels of ketones or aldehydes corresponding to the starting oxime, which can then destroy fast scavenger. To generate fast scavenger, it has been found that the oxime compound should be subjected to a temperature of at least about 100° C.

Operating Examples

The following detailed operating examples illustrate the practice of the invention in its most preferred form, thereby permitting a person of ordinary skill in the art to practice the invention. The principles of this invention, its operating parameters and other obvious modifications thereof will be understood in view of the following detailed procedure.

Examples 1-7

To demonstrate that fast scavenger inhibits foulant formation instead of the oxime itself, a mixture of an oxime and toluene was placed in a one liter stainless steel autoclave under an inert atmosphere and heated. To form the fast scavenger in the individual runs, varying amounts of methylethylketoxime ($H_3C(C{=}NOH)CH_2CH_3$) were added to 800 g of toluene sparged with nitrogen to form mixtures having concentrations of oxime from 500 to 2000 ppm in toluene. The toluene was used in these runs only as a carrier for the oxime and fast scavenger. The individual mixtures were autoclaved under nitrogen for one hour at 230° F. For each run, the mixture was collected under nitrogen and 20 g of the mixture was added to a three neck 250 ml distillation flask along with 80 g of vinyl acetate and 0.07 g of lauroyl peroxide, a polymerization promoter. The contents of the flask were agitated and heated to 75° C. under nitrogen for one hour and forty-five minutes. The contents were then collected in a sealed container and allowed to cool to room temperature. The viscosity of the contents, cooled to room temperature, was measured using a RV model Brookfield viscometer, spindle No. 6 at 100 rpm.

The following table summarizes the results:

TABLE I

| Example | Oxime Autoclaved | Oxime Concentration* (ppm) | Final Viscosity of Mixture (centipoise) |
|---|---|---|---|
| 1 | no | 0 | 500 |
| 2 | no | 200 | 500 |
| 3 | yes | 100 | 400 |
| 4 | yes | 150 | 275 |
| 5 | yes | 200 | 100 |
| 6 | yes | 300 | 100 |
| 7 | yes | 400 | 100 |

*The oxime concentration is expressed as a ratio of oxime to the mixture of vinyl acetate and toluene.

As the data demonstrate, vinyl acetate treated under the above conditions without an added oxime had a final viscosity of 500 centipoise. A rerun of the polymerization reaction with unautoclaved methylethylketoxime had no effect on reducing the viscosity of the vinyl acetate. The remaining Examples show that the viscosity of the mixture containing vinyl acetate reached a minimum of 100 centipoise at an autoclaved oxime concentration level of 200 ppm. Further increases in oxime concentration had no further effect in decreasing the viscosity of the vinyl acetate mixture. For comparison, a 4:1 mixture of vinyl acetate and toluene similar to the blend ratio of the above examples also had a viscosity of 100 centipoise.

Because of the wide range of operating parameters encountered in the processing of polymerizable compounds, as well as the wide range of reactivities of the various polymerizable materials, the concentration of the fast scavenger in the process stream which results in minimum fouling is determined typically by observation. Once the concentration for achieving the desired antifouling effect is determined, a dose rate is established to maintain a concentration of the antifoulant in the organic stream sufficient to maintain minimum fouling. The dosage of antifoulant is injected into the non-aqueous process stream by a metering device, such as a chemical feed pump of the type supplied by Neptune, Inc., Lansdale, Pa. The device maintains a substantially constant concentration of the antifoulant in the process stream. The particular oxime compound incorporated in the non-aqueous process stream is selected in part for its solubility in the process stream. Upon injection into the process stream, the oxime is heated to temperatures of at least about 100° C. to form fast scavenger.

Factors which affect the dosage level of the antifoulant include the chemical composition of the organic stream; the temperature and pressure of the environment within the processing equipment; the type and metallurgical properties of the processing equipment; the presence of oxygen, other contaminants and trace metals in the organic stream; and the efficiency of the particular antifoulant in the particular organic stream.

It is believed that, in addition to the inhibition effect the particular oxime compounds have on materials such as vinyl acetate, the tendency of fouling in other polymerizable compounds such as acrylates, methacrylates, vinyl chloride, styrene, acetonitrile, butadiene, and acrylonitrile, among others, will be reduced similarly.

While the invention has been described in conjunction with specific embodiments thereof, it is evident that many alternatives, modifications, and variations will be apparent to those skilled in the art in light of the foregoing description.

What is claimed is:

1. A method for inhibiting fouling caused by reaction of organic compounds in a process stream substantially free of water, comprising adding to said process stream an effective amount of an oxime compound, said oxime compound heated to at least about 100° C., said oxime compound having the formula:

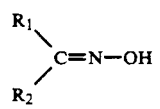

in which $R_1$ and $R_2$ are the same or different and are selected from hydrogen, lower alkyl groups of 1–8 carbon atoms and aryl groups.

2. The method of claim 1 wherein said organic compound is vinyl acetate.

3. The method of claim 1 wherein said organic compound is an acrylate.

4. The method of claim 1 wherein said organic compound is acrylonitrile.

5. The method of claim 1 wherein said oxime compound is added to said process stream by a metering device to maintain a substantially constant concentration level.

* * * * *